United States Patent [19]

Kasuga

[11] 4,083,316

[45] Apr. 11, 1978

[54] SEWING MACHINE

[75] Inventor: Noboru Kasuga, Hachioji, Japan

[73] Assignee: Janome Sewing Machine Co. Ltd., Tokyo, Japan

[21] Appl. No.: 589,531

[22] Filed: Jun. 23, 1975

[30] Foreign Application Priority Data

Jun. 24, 1974 Japan ..... 49-71256
Jun. 28, 1974 Japan ..... 49-73241

[51] Int. Cl.[2] ..... D05B 69/22
[52] U.S. Cl. ..... 112/274
[58] Field of Search ..... 112/219 R, 219 A, 220, 112/221, 67, 87, 158 R; 192/138, 139, 143

[56] References Cited

U.S. PATENT DOCUMENTS 3,253,685 5/1966 Marola et al. ..... 112/219 A

*Primary Examiner*—H. Hampton Hunter
*Attorney, Agent, or Firm*—Michael J. Striker

[57] ABSTRACT

A sewing machine for making continuous and intermittent stitches has a main shaft which is continuously rotated by a pulley and a clutch mechanism during the making of continuous stitches. The clutch mechanism is repeatedly disengaged by a blocking device when the machine makes intermittent stitches. The blocking device is rotatable, within limits, on the main shaft and can be arrested by a pawl which is mounted on a holder controlled by a stitch selecting cam. The cam can move the pawl nearer to or further away from the blocking device and the pawl has a follower which is located in the path of movement of a second cam, which is integral with the blocking device or rotates with the main shaft, when the stitch selecting cam has moved the pawl nearer to the blocking device whereby the rotating second cam pivots a pallet of the pawl into the path of movement of a shoulder on the blocking device. The clutch mechanism has an actuating lever which normally couples the pulley to the main shaft but disengages the pulley from the main shaft when pivoted by a surface on the blocking device while the latter is held by the pawl. When the stitch selecting cam is set for intermittent stitching, each actuation of the foot pedal results in rotation of the main shaft through one full revolution, and the main shaft thereupon arrests the needle in the upper dead center position.

19 Claims, 19 Drawing Figures

24
25
10
20
26
7
22
9
13
14
16
27
15
8
38
11
12
49a
50
40
44
39
7
37
36
35
42
41
52
51
48
55
1
6
5
5a
3
4
2

SEWING MACHINE

BACKGROUND OF THE INVENTION

The present invention relates to sewing machines in general, and more particularly to improvements in sewing machines which can be used for continuous or intermittent stitching.

It is already known to construct a sewing machine, e.g., a household zig-zag sewing machine, in such a way that the machine can be used for ordinary continuous stitching or for the making of intermittent stitches. Presently known sewing machines of the just outlined character are complex and prevent the user from properly manipulating the material to be sewn. This is due to the fact that the operator must use one hand to arrest the machine upon completion of a stitch so that only the other hand is available for holding and guiding the material which is being sewn. The problem is aggravated when the operator wishes to sew curved pieces of material because such operation necessitates a highly accurate guidance of the material. Another drawback of presently known sewing machines for continuous and intermittent stitching is their high initial and maintenance cost as well as that the position of the needle in idle position of the main shaft cannot be determined with a requisite degree of accuracy and reproducibility. This is the reason that the majority of presently sold household sewing machines do not embody the continuous and intermittent stitching features.

SUMMARY OF THE INVENTION

An object of the invention is to provide a sewing machine with simple, compact, inexpensive, rugged and reliable means for enabling the machine to make continuous or intermittent stitches.

Another object of the invention is to provide a sewing machine of the just outlined character wherein both hands of the operator remain free for manipulation of the material to be sewn, irrespective of whether the machine is to make ordinary continuous stitches or intermittent stitches.

A further object of the invention is to provide a sewing machine wherein a minimal number of additional parts are necessary to enable the operator to make conventional continuous as well as intermittent stitches, and wherein the conversion from one type of stitching to the other type of stitching or vice versa is not only simple but also does not require any lengthy interruptions in operation of the machine.

An additional object of the invention is to provide a sewing machine for the making of continuous or intermittent stitches wherein the needle can be arrested in a predetermined position in response to each and every stoppage of the main shaft, at least when the machine is used for intermittent stitching.

Still another object of the invention is to provide the machine with novel and improved means for insuring gradual and smooth stoppage of the main shaft during intermittent stitching, with novel and improved means for stopping the main shaft and the needle without necessitating stoppage of the motor so that the motor is not likely to be overheated, and with novel and improved means for moving the needle to make a stitch and thereupon arresting the needle in a predetermined position by the simple expedient of actuating the foot pedal.

The invention is embodied in a sewing machine for continuous and intermittent stitching. The machine comprises a housing or frame, a main shaft which transmits motion to the needle and is rotatably mounted in the housing, means for rotating the shaft including a pulley or an analogous driver member which is coaxial with the main shaft and a clutch mechanism which is installed between the driver member and the main shaft to rotate the main shaft during continuous stitching, and means for disengaging the clutch mechanism for the purpose of making intermittent stitches. The disengaging means comprises a rotary blocking device which normally receives torque from the rotating means (preferably by way of a friction clutch which is rotated by the driver member) to thereby maintain the clutch mechanism in engaged condition, and means for arresting the blocking device to thereby disengage the clutch mechanism. The arresting means comprises a stitch selecting assembly having a portion movable between a first position in which the blocking device is free to rotate and a second position in which the aforementioned portion of the assembly holds the blocking device against rotation to thereby disengage the clutch mechanism.

The assembly may comprise a stitch selecting cam which is rotatable by the operator between a first and a second position, a holder which is pivotably mounted in the housing and has a follower tracking the cam to be pivoted from a first to a second position when the cam is respectively rotated to its first and second positions, and a pawl which constitutes the aforementioned portion of the assembly and is pivotably mounted on the holder to be respectively moved away from and nearer to the blocking device in response to movement of the holder to the first and second positions. The pawl has a pallet which can engage a shoulder on the blocking device when the holder assumes its second position and the pawl is pivoted by a second cam which forms part of or rotates with the blocking device.

The novel features which are considered as characteristic of the invention are set forth in particular in the appended claims. The improved sewing machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
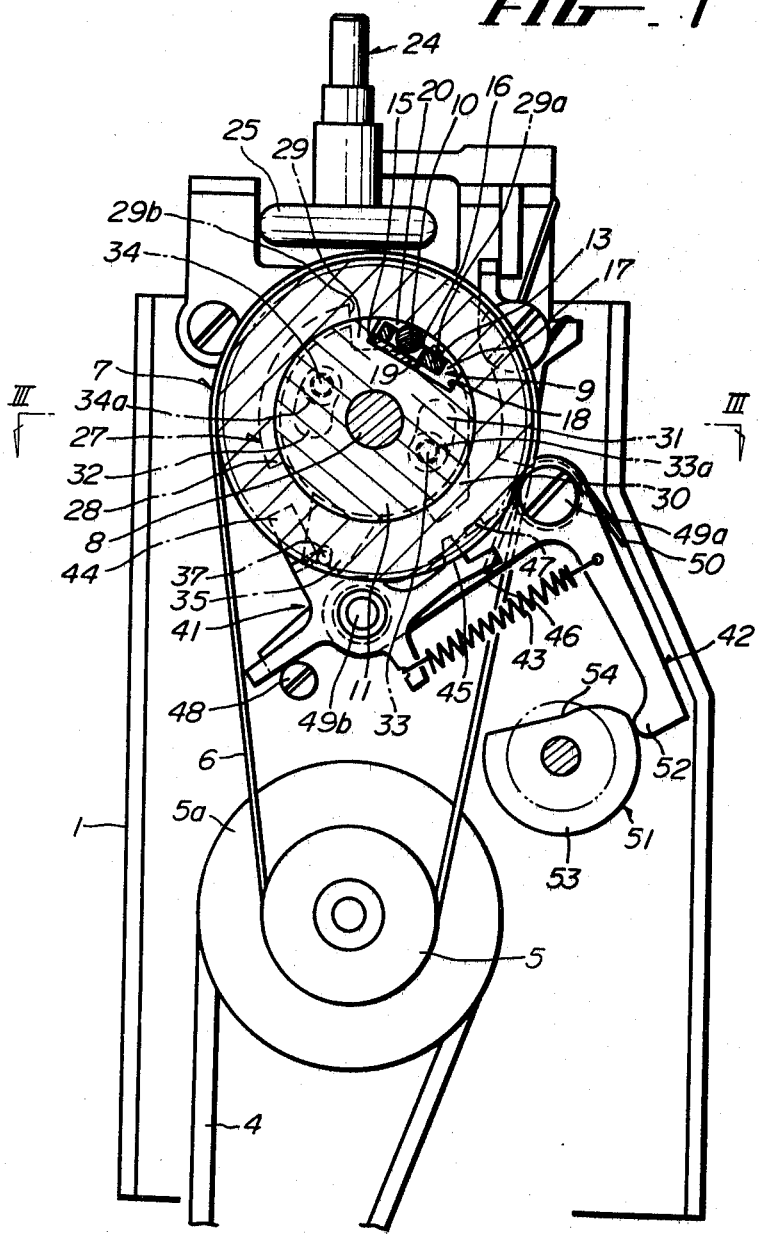
FIG. 1 is a fragmentary partly end elevational and partly vertical sectional view of a sewing machine which embodies one form of the invention, the section being taken in the direction of arrows as seen from the line I—I of FIG. 3.
Figure 2:
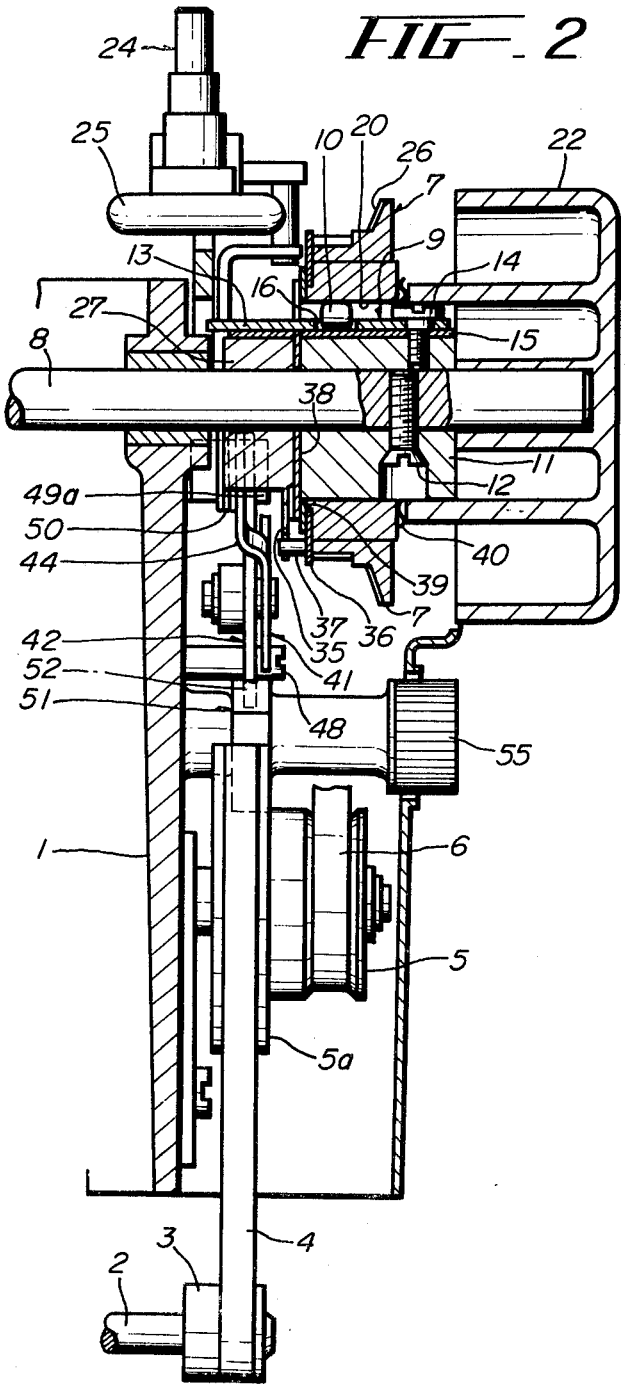
FIG. 2 is a sectional view as seen in the direction of arrows from the line II—II of FIG. 3.

Referring first to FIGS. 1 to 8, there is shown a portion of a household sewing machine which comprises a housing or frame 1 supporting a shaft for two coaxial pulleys 5 and 5*a*. The larger pulley 5*a* is driven by an endless belt 4 which is further trained over a smaller pulley 3 mounted on the output shaft 2 of a prime mover, e.g., an electric motor which can be started or arrested by a conventional foot pedal, not shown. The pulley 5 drives a second endless belt 6 which is trained over a larger pulley 7 rotatably mounted on and serving as a driver member for a main shaft 8 which is journalled in the housing 1. The pulley 7 can rotate the main shaft 8 through the medium of a clutch mechanism 9 having a roller-shaped clutch element 10 adapted to cooperate with a complementary clutch element 15 on the shaft 8. The clutch element 15 is mounted in a bushing 11 which is affixed to the main shaft 8 by one or more screws 12 or analogous fastener means. The bushing 11 has an elongated groove 17 which is machined into its periphery and extends in parallelism with the main shaft 8. The parts 2–5, 5*a*, 6, 7 and 9 together constitute a means for rotating the shaft 8 during continuous stitching.

The clutch mechanism 9 further comprises an actuating member here shown as a lever 13 one end of which is mounted on a pivot 14 secured to the bushing 11 and located in the groove 17. The lever 13 is biased clockwise, as viewed in FIG. 3, by a torsion spring 21. An intermediate portion of the lever 13 has a rectangular hole 16 which receives the roller 10; the latter is inserted in such a way that its axis is parallel or substantially parallel to the axis of the main shaft 8.

The clutch element 15 is mounted in the innermost portion 18 of the groove 17. A portion 19 of the clutch element 15 constitutes a cam which is engaged by the roller 10 of the clutch mechanism 9. When the roller 10 engages a raised portion of the cam 19 (see FIG. 1), and the output shaft 2 drives the pulley 7 in a counterclockwise direction, the inner surface 20 of the pulley 7 urges the roller 10 against the cam 19 so that the pulley 7 transmits torque to the main shaft 8 through the medium of the bushing 11. When the angular position of the lever 13 is changed against the opposition of torsion spring 21 to move the roller 10 off the raised portion of the cam 19, the inner surface 20 of the pulley 7 can rotate relative to the bushing 11 and main shaft 8.

The bushing 11 is rigidly connected with a flywheel 22 by one or more screws 23 or analogous fastener means. The flywheel 22 surrounds one end portion of the main shaft 8. The reference character 24 denotes a thread winding device which is mounted on the housing 1 and has a rubber wheel 25 which can be moved into frictional engagement with a flange 26 of the pulley 7 when the operator of the sewing machine desires to wind the thread onto a bobbin. During such winding of thread, the pulley 7 rotates relative to the main shaft 8 and bushing 11.

The sewing machine further comprises a blocking device or stop 27 which is mounted on and is turnable relative to the main shaft 8 at that side of the pulley 7 which is remote from the flange 26. The blocking device 27 has a cutout or notch 29 flanked by two substantially radially extending surfaces 29*a* and 29*b*, a cam 30, a bifurcated arm 35, and a radially extending shoulder 28. The cutout 29, cam 30, arm 35 and shoulder 28 are angularly offset with respect to each other, as considered in the circumferential direction of the main shaft 8. The cutout 29 receives, with clearance, the free end portion of the actuating lever 13, i.e., that end portion which is remote from the pivot 14 and extends beyond the groove 17 in the peripheral surface of the bushing 11. The lever 13 can be pivoted by the surface 29*a* or 29*b* of the blocking device 27 when the latter rotates relative to the bushing 11 and/or vice versa.

Figure 3:
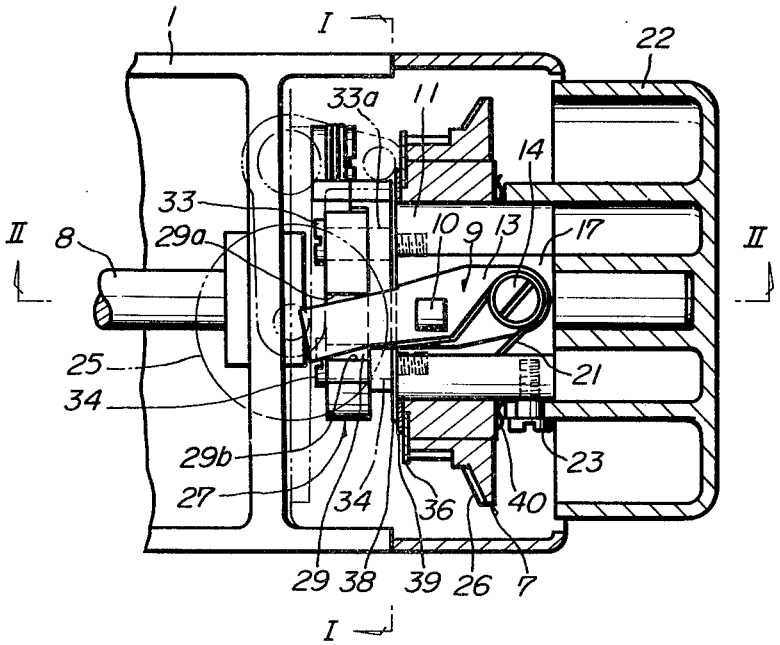
FIG. 3 is a horizontal sectional view substantially as seen in the direction of arrows from the line III—III of FIG. 1.

The blocking device 27 is adjacent to the lefthand end of the bushing 11, as viewed in FIG. 1 or 3, and has two arcuate slots 31, 32 for portions 33*a*, 34*a* of pins 33, 34 which are threadedly connected with the bushing 11. The centers of curvature of the slots 31, 32 are located on the axis of the main shaft 8 and these slots are preferably located diametrically opposite each other with respect to the common axis of the shaft 8, bushing 11 and pulley 7. The length of the slots 31, 32 (as considered in the circumferential direction of the shaft 8) determines the extent to which the blocking device 27 can turn relative to the bushing 11 or vice versa. The configuration of at least one of the pins 33, 34 is preferably such that the one pin holds the blocking device 27 against excessive axial movement with respect to the bushing 11.

The prongs of the bifurcated arm 35 on the blocking device 27 straddle a pin or stud 37 which is affixed to a ring 36 forming part of a friction clutch between the pulley 7 and the blocking device. Two washers 38, 39 are interposed between the ring 36 and blocking device 27; the washer 38 is affixed to the bushing 11 by the threaded end portions of the pins 33, 34. Thus, the pulley 7, ring 36 and washer 39 can rotate relative to the bushing 11 and washer 38. As shown in FIG. 3, an elastic washer 40 (which constitutes a dished spring) is placed between the flywheel 22 and the pulley 7 so that the pulley 7 is biased axially toward the blocking device 27 and is in frictional engagement with the ring 36 whose stud 37 extends into the space between the prongs on the arm 35 of the blocking device 27. Thus, the blocking device 27 normally rotates with the pulley 7. When the blocking device 27 is arrested by a pawl 41, the pulley 7 can rotate relative to the blocking device; the pulley 7 then simply slides with respect to the ring 36 of the friction clutch. However, the blocking device 27 begins to rotate again as soon as the shoulder 28 is released.

Figure 4:
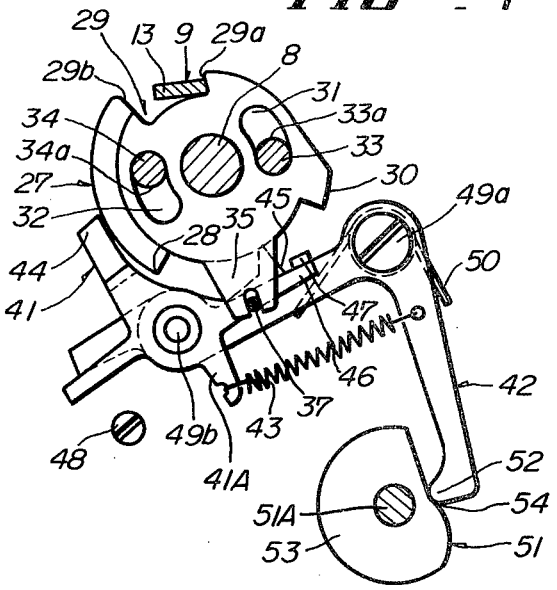
FIG. 4 illustrates a detail of the structure shown in FIG. 1, with the stitch selecting cam in a position in which the machine is set for intermittent stitching.

FIG. 4 shows that the pawl 41 resembles a bell crank one arm of which carries a pallet 44 and the other arm of which carries a follower 45. An intermediate portion of the pawl 41 is turnable on a pivot 49*b* mounted on one arm of a two-armed lever or holder 42. The pawl 41 is biased counterclockwise, as viewed in FIG. 4, by a helical spring 43 one end of which is connected to a post 41A of the pawl 41 and the other end of which is connected to the other arm of the holder 42. The pallet 44 of the pawl 41 can move into the path of the shoulder 28 on the blocking device 27 when the pawl is caused to pivot clockwise, as viewed in FIG. 4 against the opposition of the spring 43. The blocking device 27 is then arrested, i.e., the pulley 7 will rotate relative to the blocking device if the motor (whose output shaft 2 drives the pulley 7) is on while the pallet 44 engages the shoulder 28. The follower 45 on the other arm of the pawl 41 can track the cam 30 of the blocking device 27 whereby the cam 30 causes the pawl to turn clockwise, as viewed in FIG. 4, and places the pallet 44 into the path of movement of the shoulder 28.

The follower 45 of the pawl 41 has an extension 46 which can be engaged and displaced by a projection or lug 47 on the one arm of the holder 42. The lug 47 serves to limit the extent of counterclockwise pivotal movement of the pawl 41. A stop 48 in the housing 1 of the sewing machine serves to limit the extent of counterclockwise pivotal movement of the holder 42. The latter is fulcrumed in the housing 1, as at 49*a*, and is biased clockwise, as viewed in FIG. 4, by a torsion spring 50. The other arm of the holder 42 has a follower 52 which tracks the face of a disk-shaped stitch selecting cam 51 mounted on a shaft 51A which can be rotated by a knob 55; the latter is accessible at the outer side of the housing 1 (see FIG. 2).

The stitch selecting cam 51 has a larger-diameter portion 53 and a smaller-diameter portion 54, i.e., the face of the cam 51 has first and second portions which are respectively more distant from and nearer to the axis of the shaft 51*a*. When the follower 52 of the holder 42 engages the portion 53 of the cam 51 (see FIG. 1), the sewing machine is set for normal operation. The machine is set for intermittent stitching when the follower 52 engages the portion 54 of the face on the cam 51 (see FIGS. 4 and 8). The shaft 51A and/or the knob 55 may be provided with detent means (not shown) for yieldably holding the cam 51 in the position of FIG. 1 or 4.

The operation:

When the operator wishes to set the machine for ordinary continuous stitching, the cam 51 is rotated to the position shown in FIG. 1. The larger-diameter portion 53 of the face on the cam 51 then maintains the holder 42 in an angular position in which the holder stresses the torsion spring 50 and maintains the pawl 41 out of contact with (i.e., in a position remote from) the blocking device 27. Thus, the pallet 44 is located radially outwardly of the path of movement of the shoulder 28 and the follower 45 is located radially outwardly of the cam 30 on the blocking device 27. The one arm of the holder 42 abuts against the stationary stop 48 in the housing 1 (see FIG. 1). If the operator starts the motor, the output shaft 2 of the motor drives the pulley 7 which rotates counterclockwise and drives the main shaft 8 in the same direction (through the medium of the clutch mechanism 9). The main shaft 8 transmits motion to those parts (not shown because conventional) of the sewing machine which produce a continuous stitch. The pins 33, 34 of the bushing 11 assume the positions shown in FIG. 1 in which they are located in the rearmost portions of the respective arcuate slots 31, 32 (the pulley 7 is assumed to rotate counterclockwise, as viewed in FIG. 1). The actuating lever 13 of the clutch mechanism 9 abuts against the surface 29*a* in the cutout 29 of the blocking device 27. Consequently, the lever 13 maintains the roller 10 in engagement with the raised portion of the cam 19 so that the roller 10 is frictionally engaged by the cam 19 and by the inner surface 20 of the pulley 7, i.e., the main shaft 8 is compelled to rotate with the pulley 7. The pulley 7 is held in frictional engagement with the ring 36 so that the latter drives the blocking device 27 through the medium of the pin 37.

Figure 5:
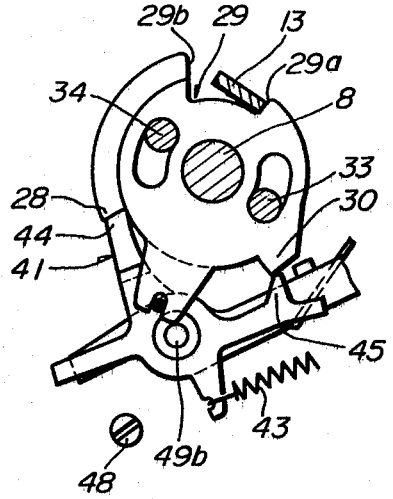
FIG. 5 shows the blocking device in one of its positions.
Figure 6:
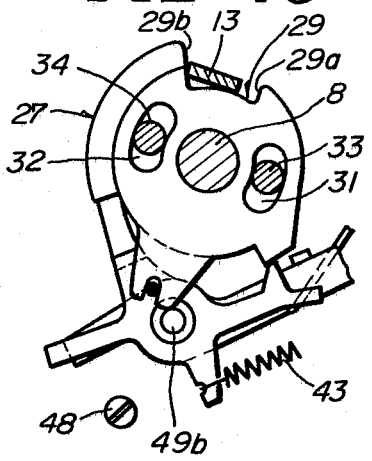
FIG. 6 shows the blocking device in another position.
Figure 7:
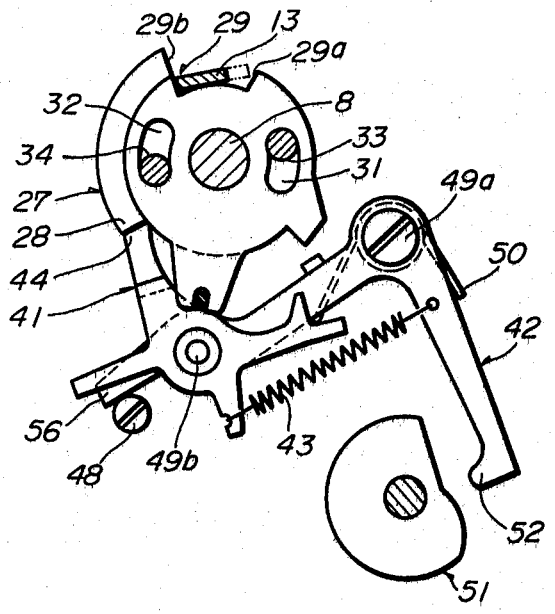
FIG. 7 shows the blocking device in a third position.
Figure 8:
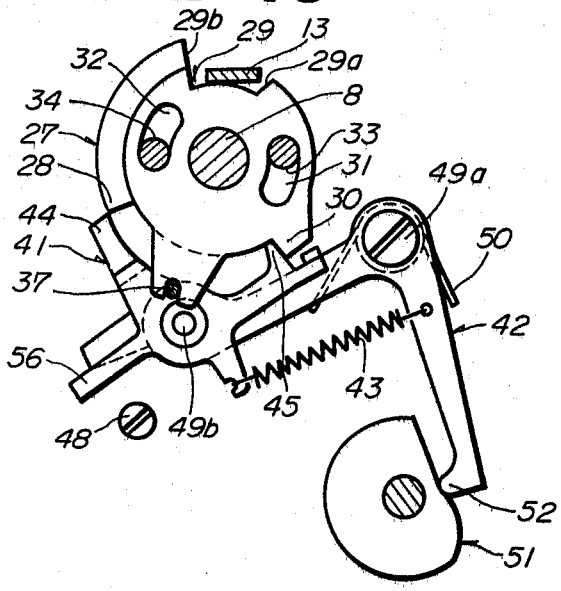
FIG. 8 shows the blocking device in the position of FIG. 7 but with its shoulder disengaged from the pawl of the stich selecting assembly.

When the machine is set for intermittent stitching, the main shaft 8 is rotated intermittently in response to activation and deactivation of the controller (e.g., the aforementioned foot pedal which can start or arrest the motor for the pulley 3). In order to set the machine for intermittent stitching, the operator turns the knob 55 to move the cam 51 to the position shown in FIG. 4 so that the follower 52 of the holder 42 bears against the smaller-diameter portion 54 of the face on the cam 51. The spring 50 maintains the follower 52 in contact with the cam 51, i.e., the holder 42 pivots clockwise and its one arm moves the pivot 49*b* for the pawl 41 nearer to the axis of the shaft 8, i.e., nearer to the blocking device 27. This moves the follower 45 into the path of movement of the cam 30 on the blocking device 27 so that the cam 30 can pivot the pawl 41 clockwise to move the pallet 44 into the path of movement of the shoulder 28. The operator then causes the pedal to start the motor so that the pulley 7 rotates counterclockwise (as viewed in FIG. 1) and rotates the main shaft 8 in the same direction because the clutch mechanism 9 is still engaged (the actuating lever 13 is engaged by the surface 29*a* in the cutout 29 of the blocking device 27). As shown in FIG. 5, the cam 30 moves relative to the pawl 41 and engages the follower 45 which causes the pallet 44 to engage the oncoming shoulder 28. The pawl 41 thereby stresses the spring 43. The thus arrested blocking device 27 immediately arrests the ring 36 of the friction clutch, i.e., the pulley 7 then rotates relative to the blocking device. Since the actuating lever 13 is still engaged by the surface 29*a* of the blocking device 27, the clutch mechanism 9 remains engaged and the pulley 7 rotates the main shaft 8 and bushing 11. However, as the pulley 7 continues to rotate while the blocking device 27 is held against rotation by the pawl 41, the pins 33, 34 begin to move in the respective slots 31, 32 (compare FIG. 5 with FIG. 6). When the pin 33, 34 are located substantially midway between the ends of the respective arcuate slots 31, 32, the lever 13 reaches the surface 29*b* of the blocking device 27 and is pivoted on the member 14 so as to move the roller 10 out of frictional engagement with the inner surface 20 of the pulley 7 and to thus disengage the clutch mechanism 9. The pulley 7 begins to rotate relative to the shaft 8 but the latter continues to rotate due to inertia. Therefore, the shaft 8 causes the bushing 11 to move the pins 33, 34 relative to the slots 31, 32 so that the pins 33, 34 tend to turn the blocking device 27 counterclockwise, as viewed in FIG. 7. The shoulder 28 pivots the pawl 41 relative to the holder 42 and causes the holder to pivot on the member 49*a* until the tip 56 of the one arm of the holder 42 reaches the stop 48. The follower 52 of the holder 42 is then disengaged from the smaller-diameter portion 54 of the face on the stitch selecting cam 51. The just mentioned pivoting of pawl 41 relative to the holder 42 results in stressing of the spring 47 and the pivoting of holder 42 results in stressing of the spring 50.

In the meantime, the speed of the main shaft 8 decreases (this shaft is held in rotary motion exclusively due to inertia as soon as the clutch mechanism 9 is disengaged). If the torsion spring 50 is made stronger than the friction between the ring 36 and pulley 7, the spring 50 can cause the main shaft 8 to rotate in the opposite direction (clockwise, as viewed in FIG. 7) so that the follower 52 of the holder 42 returns into contact with the portion 54 of the cam 51. This automatically terminates clockwise rotation of the main shaft 8. However, the pulley 7 continues to rotate and slides with respect to the ring 36; therefore, the shoulder 28 of the blocking device 27 continues to bear against the pallet 44 of the pawl 41.

When the pedal causes the motor to stop, the pulley 7 is arrested and ceases to transmit torque to the ring 36. Therefore, the spring 43 can turn the pawl 41 counterclockwise as viewed in FIG. 7, so that the pallet 44 assumes the position shown in FIG. 8, and is disengaged from the shoulder 28. At the same time, the follower 45 of the pawl 41 returns into the path of movement of the cam 30 so that the blocking device 27 is ready to return the pallet 44 into the path of movement of the shoulder 28 as soon as the motor is started again to rotate the pulley 7 anticlockwise. The same operation, with intermittent stitching, is repeated again and again, as often as necessary. Thus, when the operator starts the motor again, the pulley 7 drives the ring 36 and the pin 37 begins to rotate the blocking device 27. The latter moves from the position of FIG. 8 back to the position of FIG. 4 and the surface 29*a* in the cutout 29 pivots the actuating lever 13 so that the clutch mechanism 9 is engaged and rotates the main shaft 8 and bushing 11 in response to rotation of the pulley 7. The machine is driven and the needle (which receives motion from the shaft 8) produces a stitch. The main shaft 8 can be readily set to stop the needle in the upper dead center position whenever the clutch mechanism 9 is disengaged and the main shaft 8 comes to a full stop subsequent (a) to temporary rotation due to inertia and (b) subsequent to rotation in the opposite direction under the action of the spring 50.

FIGS. 9 to 18 show a second sewing machine wherein all such parts which are identical with or clearly analogous to the corresponding parts of the first machine are denoted by similar reference characters. The second sewing machine employs a pawl 41*a* and a holder 42*a*. The pawl 41*a* cooperates with a blocking device 27*a* and is substantially V-shaped. Its pallet 44*a* can enter the path of movement of the shoulder 28 on the blocking device 27*a*. The follower 45*a* of the pawl 41*a* cooperates with a cam 30*a* in the same way as described in connection with FIGS. 1–8. The holder 42*a* is a two-armed lever one arm of which carries the pivot 49*b* for the pawl 41*a*. The helical spring 43 of FIGS. 1–8 is replaced with a torsion spring 43*a* which biases the pawl 41*a* clockwise, as viewed in FIG. 9. The holder 42*a* is fulcrumed in the housing 1, as at 49*a*, and is biased anticlockwise, as viewed in FIG. 9, by a torsion spring 50*b*. When the spring 50*b* is free to dissipate energy, the holder 42*a* abuts against the stop 48 in the housing 1. One arm of the pawl 41*a* can also engage the stop 48. The follower 52*a* of the holder 42*a* cooperates with the stitch selecting cam 51*a*.

The cam 30*a* does not form part of the blocking device 27; instead, the cam 30*a* is fixedly mounted on the bushing 11 by means of the pins 33, 34. The extent to which the blocking device 27 is turnable relative to the main shaft 8 is determined by the arcuate slots 31, 32 and pins 33, 34.

Figure 9:
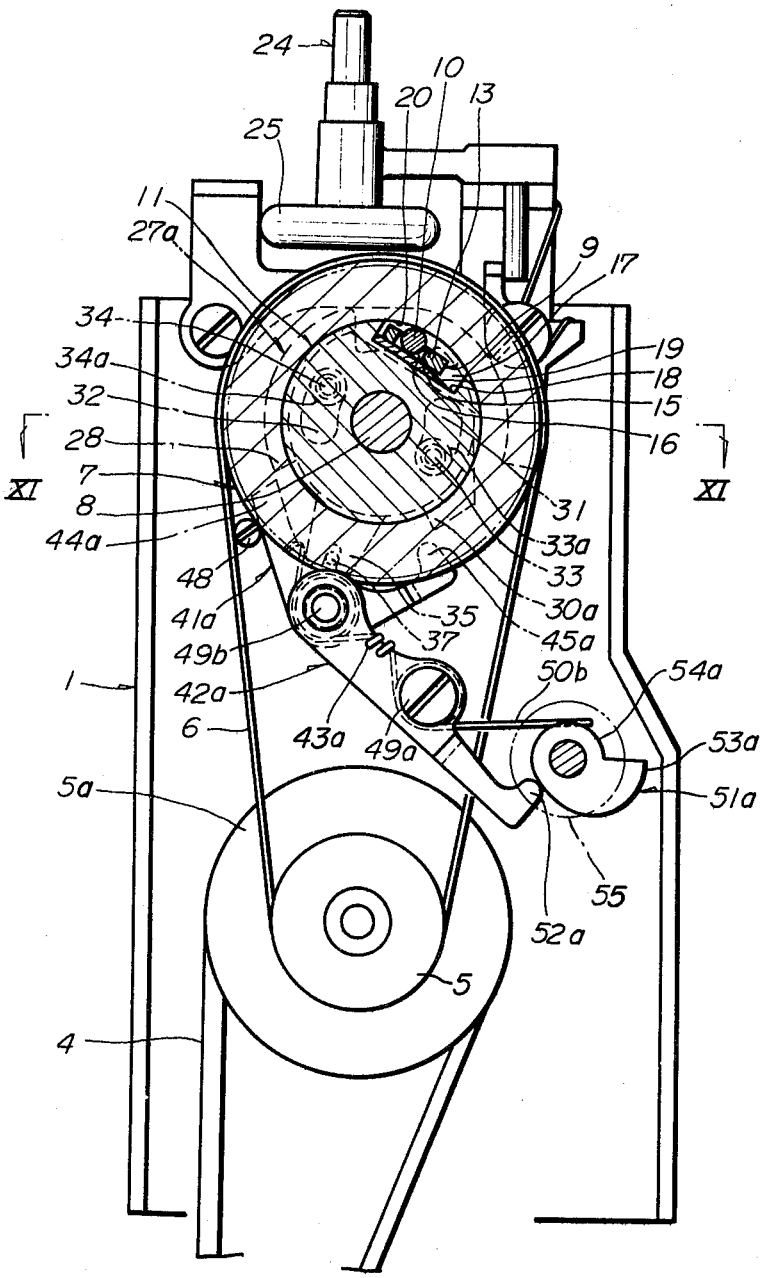
FIG. 9 illustrates a second sewing machine in a view corresponding to that of FIG. 1, the section being taken in the direction of arrows as seen from the line IX—IX of FIG. 11.
Figure 10:
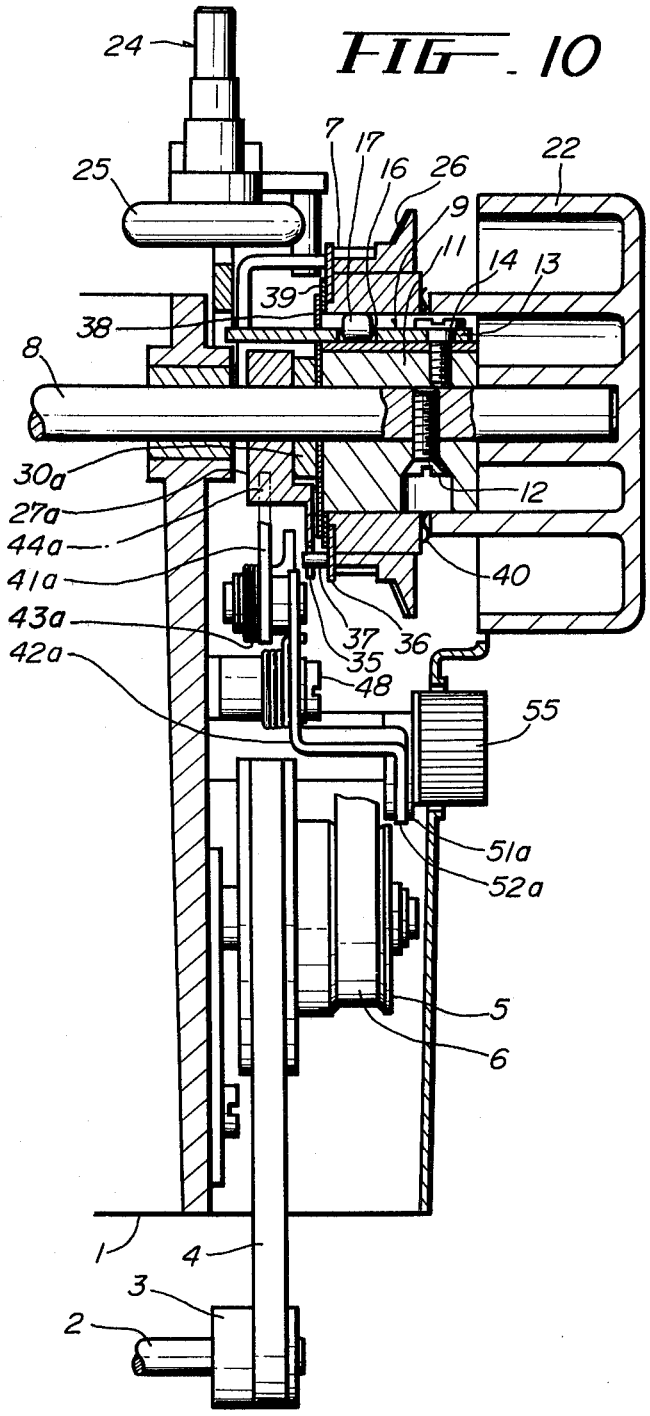
FIG. 10 is a sectional view as seen in the direction of arrows from the line X—X of FIG. 11.
Figure 11:
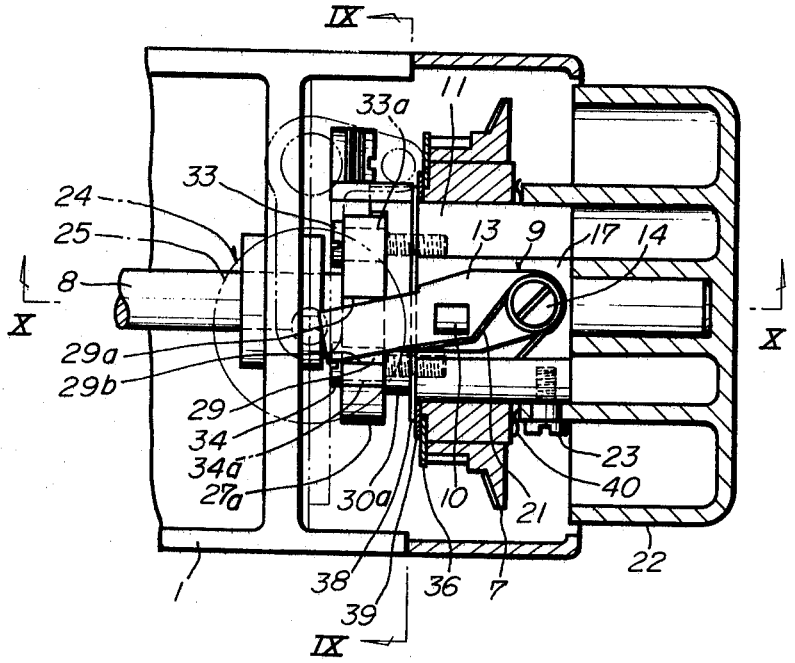
FIG. 11 is a horizontal sectional view substantially as seen in the direction of arrows from the line XI—XI of FIG. 9.
Figure 12:
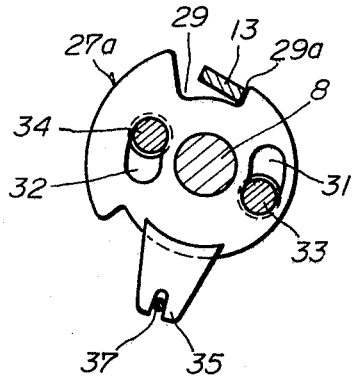
FIG. 12 is an elevational view of the blocking device in the second sewing machine.
Figure 13:
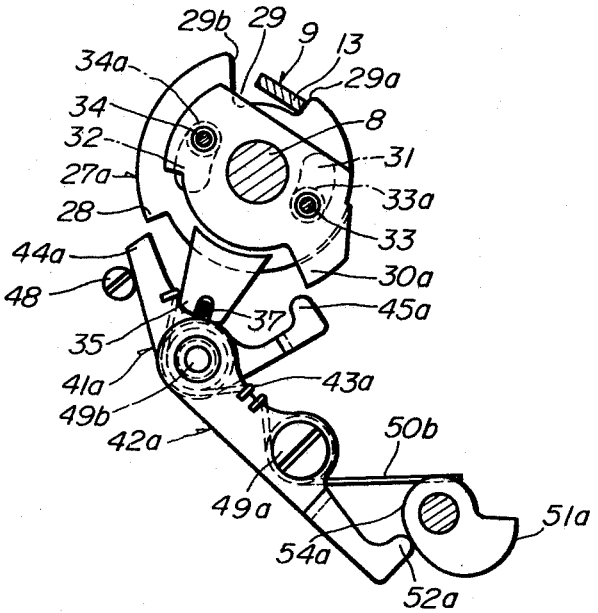
FIG. 13 shows the blocking device of FIG. 12 and the stitch selecting assembly with the latter's cam in a position it assumes during continuous stitching.

The operation of the second machine is as follows:

If the operator wishes the machine to produce ordinary continuous stitches, the knob 55 is rotated to move the cam 51*a* to the angular position shown in FIG. 9 or 13. The follower 52*a* of the holder 42*a* then engages the smaller-diameter portion 54*a* of the face on the cam 51*a* and is biased against the cam 51*a* by the torsion spring 50*b*. This moves the pallet 44*a* and the follower 45*a* of the pawl 41*a* out of the path of movement of the shoulder 28 on the blocking device 27*a* and out of the path of movement of the lobe on the cam 30*a*. Thus, the cam 30*a* is free to rotate with the bushing 11 which is rotated by the roller 10 in the opening 16 of the actuating lever 13. The clutch mechanism 9 is engaged because the lever 13 is engaged by the surface 29*a* in the cutout 29 of the blocking device 27*a*, i.e., the roller 10 is in frictional engagement with the inner surface 20 of the pulley 7 and with the cam 19 of the clutch element 15 in the deepmost portion 18 of the groove 17 of the bushing 11. The main shaft 8 rotates with the pulley 7 and causes the needle (not shown) to produce continuous stitches. The ring 36 is frictionally engaged by the pulley 7 and its pin 37 rotates the blocking device 27*a*. The pins 33, 34 are received in the rearmost portions of arcuate slots 31, 32 in the blocking device 27*a*.

Figure 14:
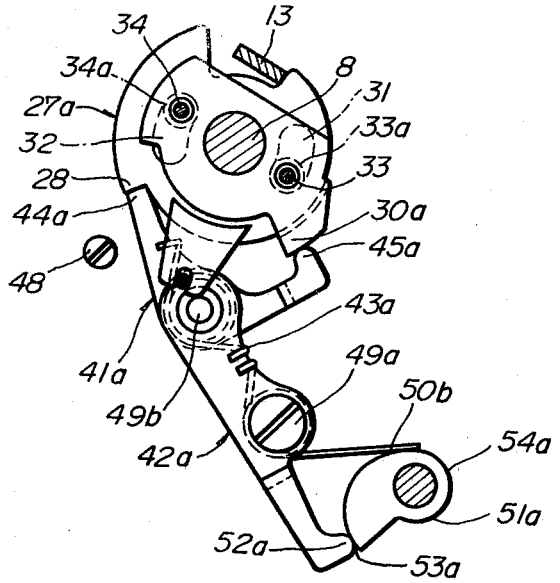
FIG. 14 illustrates the structure of FIG. 13 but with the stitch selecting cam in a position in which the second machine is set for intermittent stitching.
Figure 15:
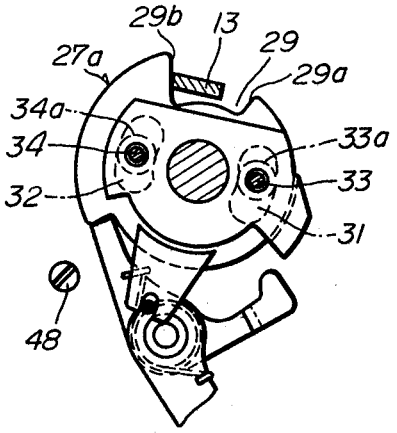
FIG. 15 illustrates a portion of the structure shown in FIG. 14 but with the blocking device in a different position.
Figure 16:
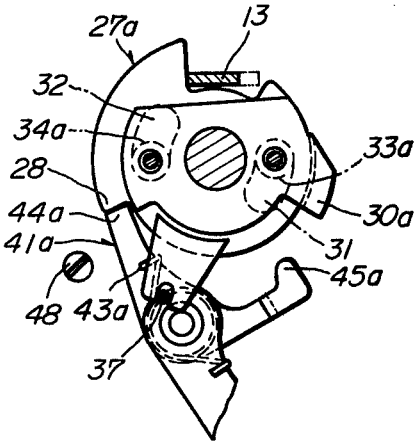
FIG. 16 shows the structure of FIG. 15 but with the blocking device in a further position.
Figure 17:
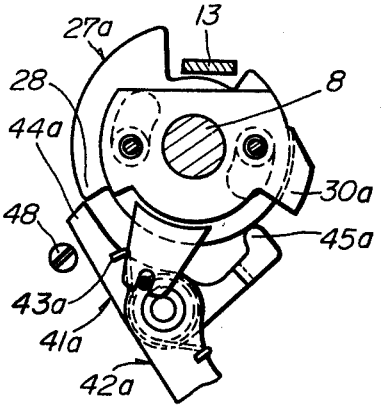
FIG. 17 shows the structure of FIG. 15 or 16 but with the pallet of the pawl of the stitch selecting assembly disengaged from the blocking device.

In order to cause the machine to produce intermittent stitches, the operator turns the knob 55 so as to move the cam 51*a* to the position shown in FIG. 14 in which the follower 52*a* of the holder 42*a* engages the larger-diameter portion 53*a* of the face on the cam 51*a*. The holder 42*a* is thereby pivoted clockwise and moves the follower 45*a* of the pawl 41*a* into the path of movement of the lobe on the cam 30*a* which rotates with the bushing 11. When the lobe of the cam 30*a* engages the follower 45*a*, the pallet 44*a* of the pawl 41*a* is moved into the path of movement of the oncoming shoulder 28 and arrests the blocking device 27*a*. However, the lever 13 still remains in engagement with the surface 29*a* so that the clutch mechanism 9 continues to rotate the bushing 11 and the main shaft 8. The bushing 11 moves the pins 33, 34 relative to the respective arcuate slots 31, 32 (compare FIGS. 14 and 15). The lever 13 begins to pivot when it engages the surface 29*b* in the cutout 29 whereby the clutch mechanism 9 is disengaged and the pulley 7 rotates relative to the bushing 11 and main shaft 8. The shaft 8 continues to rotate due to inertia and causes the bushing 11 to move the pins 33, 34 into the front end portions of the respective slots 31, 32 (see FIG. 16). The ring 36 is in frictional engagement with the rotating pulley 7 and tends to rotate the blocking device 27*a* counterclockwise through the medium of the pin 37. Therefore, the shoulder 28 bears against the pallet 44a of the pawl 41a as long as the pulley 7 continues to rotate, i.e., the pawl 41a remains in the position shown in FIG. 16.

If the motor which drives the pulley 7 is thereupon arrested, the pulley 7 comes to a halt and ceases to urge the ring 36 in a counterclockwise direction. Therefore, the spring 43a is free to pivot the pawl 41a counterclockwise to the position shown in FIG. 17 in which the pallet 44a is disengaged from the shoulder 28. The inclination of the edge face on the pallet 44a is preferably such that, when the spring 43a pivots the pawl 41a counterclockwise to the position of FIG. 17, the blocking device 27a is caused to turn clockwise and to rotate the main shaft 8 in the same direction (such angular displacement of the blocking device 27a and main shaft 8 is very small). The sewing machine is then at a standstill. However, the follower 45a is located in the path of movement of the lobe on the cam 30a so that it can pivot the pallet 44a back into the path of movement of the shoulder 28 as soon as the motor is started again. The main shaft 8 is preferably set to come to a full and final stop in an angular position in which the needle is in the upper dead center position. Thus, the needle assumes such upper position upon completion of each of a series of intermittent stitches.

Figure 18:
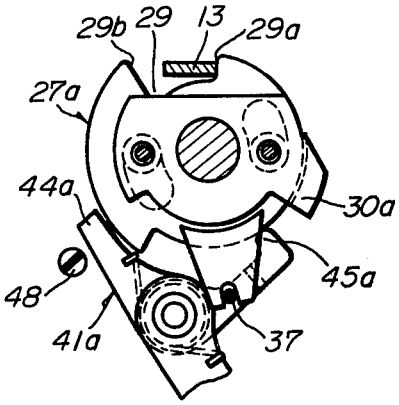
FIG. 18 illustrates the structure of FIG. 17 but with the blocking device in a different angular position.

If the operator thereupon starts the motor to rotate the pulley 7, The pulley rotates the ring 36 by friction and the pin 37 rotates the blocking device 27a in a counterclockwise direction, as viewed in FIG. 18. The lever 13 is then engaged by the surface 29a in the cutout 29 and causes the roller 10 to return into frictional engagement with the inner surface 20 and clutch element 15. This causes the bushing 11 to rotate with the main shaft 8 and cam 30a whereby the lobe of the cam 30a pivots the follower 45a to return the pallet 44a into the path of movement of the oncoming shoulder 28 on the blocking device 27a. The previously described procedure is repeated again, i.e., the main shaft 8 is finally brought to a full stop upon completion of small angular movement in a clockwise direction under the action of the spring 43a and pallet 44a in an angular position in which the needle assumes its upper dead center position. The operator can cause the machine to produce as many intermittent stitches as necessary by the simple expedient of starting and arresting the motor which drives the pulley 7. The arrangement is preferably such that each starting of the motor by the controller pedal results in rotation of the main shaft 8 through 360°. The intervals which elapse between the making of successive intermittent stitches are determines by the operator, i.e., the operator can take as much time as necessary between the making of a preceding stitch and the making of the next-following stitch. At the same time, both hands remain free to manipulate the material in which the stitches are being made.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

Figure 19:
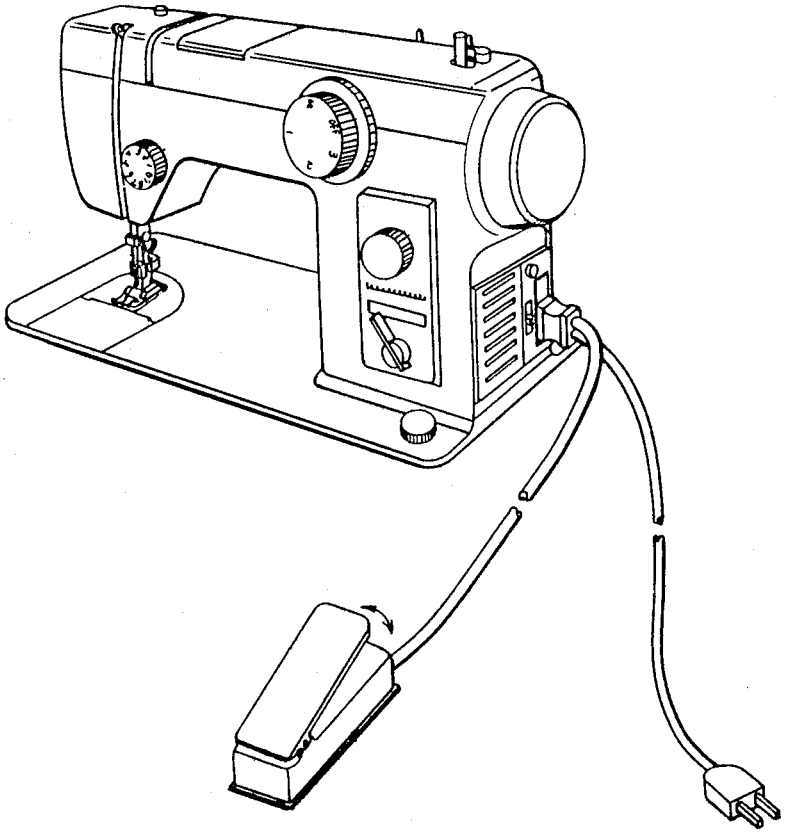
FIG. 19 is a perspective view of a sewing machine which embodies the invention and wherein the prime mover can be started and arrested by a pedal.

In this connection, a foot controller pedal which can start and stop the motor of a sewing machine and the parts which move the needle in response to rotation of the main shaft are operated in the same manner as in the prior art the outlines of which are shown in FIG. 19 drawing.

What is claimed as new and desired to be protected by Letters Patent is set forth in the appended claims.

1. In a sewing machine for continuous and intermittent stitching, a combination comprising a housing; a shaft rotatably mounted in said housing; means for rotating said shaft including a driver member coaxial with said shaft and a clutch mechanism installed between said member and said shaft to rotate said shaft during continuous stitching; and means for disengaging said clutch mechanism, including a rotary blocking device normally receiving torque from said rotating means to thereby maintain said clutch mechanism in engaged condition and means for arresting said blocking device to thereby disengage said clutch mechanism, said arresting means comprising a stitch selector assembly having a portion pivotable between a first position in which said device is free to rotate and a second position in which said portion engages and blocks said device against rotation and thereby disengages said clutch mechanism.

2. A combination as defined in claim 1, further comprising a flywheel secured to said shaft.

3. In a sewing machine for continuous and intermittent stitching, a combination comprising a housing; a shaft rotatably mounted in said housing; means for rotating said shaft including a driver member coaxial with and mounted on said shaft and a clutch mechanism installed between said member and said shaft to rotate said shaft during continuous stitching; and means for disengaging said clutch mechanism, including a rotary blocking device mounted on said shaft and normally receiving torque from said rotating means to thereby maintain said clutch mechanism in engaged condition, and means for arresting said blocking device to thereby disengage said clutch mechanism, said arresting means comprising a stitch selector assembly having a portion comprising a pawl which is pivotally movable between a first position in which said device is free to rotate and a second position in which said portion holds said device against rotation and thereby disengages said clutch mechanism, said assembly further having means for moving said pawl relative to said blocking device.

4. A combination as defined in claim 3, wherein said drive member is a pulley and further comprising a friction clutch interposed between said blocking device and said pulley.

5. A combination as defined in claim 3, wherein said clutch mechanism comprises first and second clutch elements rotatable with said shaft, and an actuating member mounted on said shaft and being movable between an operative position in which said actuating member maintains one of said elements in torque-receiving engagement with said driver member and in torque-transmitting engagement with the other of said elements so that said shaft rotates in response to rotation of said driver member, and an inoperative position in which said actuating member disengages said one element from said driver member so that said driver member can rotate relative to said shaft, said blocking device having means for moving said actuating member to said inoperative position in response to movement of said pawl to said second position.

6. A combination as defined in claim 5, wherein said actuating member is a lever which is pivotably mounted on said shaft.

7. A combination as defined in claim 6, wherein said blocking device is rotatable by said driver member relative to said shaft and has a cutout and first and second surfaces in said cutout, said lever extending into said cutout so as to be held in said operative position by one of said surfaces when said blocking device rotates with said shaft and to be moved to said inoperative position by the other of said surfaces when said driver member rotates said blocking device relative to said shaft.

8. A combination as defined in claim 3, further comprising a cam rotatable with said blocking device and arranged to pivot said pawl to said second position in response to operation of said selector assembly to move said pawl from a position remote from to a position nearer to said cam.

9. A combination as defined in claim 8, wherein said blocking device has a shoulder and said pawl has a pallet which is located in the path of movement of said shoulder in response to pivoting of said pawl by said cam.

10. A combination as defined in claim 9, wherein said cam is integral with said blocking device.

11. A combination as defined in claim 9, wherein said cam is rigid with said shaft.

12. A combination as defined in claim 9, wherein said pawl has a follower which is located in the path of movement of said cam when said assembly is operated to move said pawl nearer to said cam.

13. A combination as defined in claim 3, wherein said stitch selector assembly further comprises a rotary cam and a holder mounted in said housing and being pivotable by said cam between first and second positions, said pawl being pivotably mounted on said holder and being respectively moved nearer to and further away from said blocking device in response to movement of said holder to said first and second positions thereof.

14. A combination as defined in claim 3, further comprising a bushing rotatable with said shaft and being adjacent to said blocking device, said device having at least one arcuate slot and further comprising a pin affixed to said bushing and extending into said slot to couple said device to said bushing with limited freedom of angular movement.

15. A combination as defined in claim 3, wherein said driver member is movable axially of said shaft and further comprising a friction clutch between said blocking device and said driver member, said friction clutch including a ring disposed between said driver member and said device, a pin coupling said ring to said device, and means for biasing said driver member against said ring.

16. A combination as defined in claim 15, further comprising a flywheel affixed to said shaft, said biasing means comprising an elastic washer interposed between said flywheel and said driver member.

17. A combination as defined in claim 3, wherein said blocking device is rotatable within limits relative to said shaft and further comprising a friction clutch interposed between said driver member and said device, said device having a portion which disengages said clutch mechanism when said device is engaged and arrested by said pawl so that said shaft rotates relative to said device.

18. A combination as defined in claim 17, wherein said device has another portion which re-engages said clutch mechanism subsequent to the disengagement thereof so that said shaft rotates with said device again.

19. In a sewing machine for continuous and intermittent stitching, a combination comprising a housing; a shaft rotatably mounted in said housing; driver means mounted on said shaft and rotatable relative to said shaft; a clutch mechanism installed between said driver means and said shaft, said clutch mechanism including actuating means for normally engaging said driver means to said shaft during continuous stitching; rotary blocking means mounted on said shaft for rotation therewith in a path towards said actuating means for engaging the latter; arresting means for arresting said rotary blocking means in said path at a predetermined angular position relative to said shaft so as to engage said actuating means and thereby disengage said shaft from said driver means, said arresting means being movable between a first position in which said arresting means is spaced from said path, and a second position in which said arresting means is positioned in said path for holding said rotary blocking means against rotation at said predetermined angular position; and means for selectively setting said arresting means to a selected one of said positions.

* * * * *